US009487378B2

(12) United States Patent
Lin et al.

(10) Patent No.: US 9,487,378 B2
(45) Date of Patent: Nov. 8, 2016

(54) MACHINE ROOMLESS ELEVATOR

(75) Inventors: TianMing Lin, Hang Zhou (CN); JianWei Zhang, Hang Zhou (CN); FeiQun He, Hang Zhou (CN); Guohua Zhang, Hang Zhou (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 2368 days.

(21) Appl. No.: 12/376,170

(22) PCT Filed: Aug. 10, 2007

(86) PCT No.: PCT/CN2007/002406

§ 371 (c)(1),
(2), (4) Date: Sep. 2, 2009

(87) PCT Pub. No.: WO2008/022540

PCT Pub. Date: Feb. 28, 2008

(65) Prior Publication Data

US 2010/0072000 A1 Mar. 25, 2010

(30) Foreign Application Priority Data

Aug. 11, 2006 (CN) ..... 2006 1 0052903

(51) Int. Cl.
*B66B 11/08* (2006.01)
*B66B 7/06* (2006.01)
*B66B 11/00* (2006.01)

(52) U.S. Cl.
CPC ..... *B66B 11/08* (2013.01); *B66B 11/008* (2013.01); *B66B 7/06* (2013.01)

(58) Field of Classification Search
USPC ..... 187/256, 266
IPC ..... B66B 7/06,11/08
See application file for complete search history.

(56) References Cited

U.S. PATENT DOCUMENTS 1,730,974 A * 10/1929 Higbee ..... B66B 11/08 187/266
5,009,288 A 4/1991 Nakai et al.
(Continued)

FOREIGN PATENT DOCUMENTS

CN 2632050 Y 8/2004
DE 202006002064 U1 4/2006
(Continued)

OTHER PUBLICATIONS

International Preliminary Report on Patentability for International application No. PCT/CN2007/002406 mailed Feb. 17, 2009.
(Continued)

*Primary Examiner* — William A Rivera
*Assistant Examiner* — Stefan Kruer
(74) *Attorney, Agent, or Firm* — Carlson, Gaskey & Olds

(57) ABSTRACT

A machine roomless elevator comprises a car (5) within a hoistway (14), a counterweight (1) within a space between said car (5) and a wall of said hoistway (14) and on which a plurality of counterweight suspension wheels (2) are arranged, and a traction sheave (13). Hoist ropes (4) can be devided into a plurality of groups corresponding to the number of said counterweight suspension wheels (2) after one ends thereof round said traction sheave (13), each group being fixed on a counterweight side termination after rounding corresponding one of said counterweight suspension wheels (2).

14 Claims, 6 Drawing Sheets

(56) References Cited

U.S. PATENT DOCUMENTS

| | | | | |
|---|---|---|---|---|
| 5,300,737 | A | 4/1994 | Nakanishi | |
| 5,625,174 | A | 4/1997 | Ito et al. | |
| 6,598,707 | B2 | 7/2003 | Nakagaki et al. | |
| 2004/0104079 | A1* | 6/2004 | Fischer | 187/254 |
| 2006/0016641 | A1 | 1/2006 | Koeppe, Jr. | |
| 2006/0163009 | A1 | 7/2006 | Ishii et al. | |
| 2007/0170003 | A1* | 7/2007 | Izumi et al. | 187/250 |
| 2008/0121468 | A1* | 5/2008 | Fischer | 187/256 |

FOREIGN PATENT DOCUMENTS

| | | | | | |
|---|---|---|---|---|---|
| DE | EP 1818303 | A1 * | 8/2007 | | B66B 11/008 |
| EP | 1327596 | A1 * | 7/2003 | | B66B 7/00 |
| EP | 1481935 | A1 | 12/2004 | | |
| JP | 200118903 | A | 4/2000 | | |
| JP | 2004189346 | A * | 7/2004 | | B66B 11/08 |
| WO | WO 2005005303 | A1 * | 1/2005 | | B66B 11/04 |
| WO | WO 2006005215 | A2 * | 1/2006 | | B66B 11/00 |

OTHER PUBLICATIONS

International Search Report and Written Opinion for International application No. PCT/CN2007/002406 mailed Nov. 8, 2007.

Extended European Search Report for EP 07 78 5311 dated Oct. 22, 2013.

* cited by examiner

MACHINE ROOMLESS ELEVATOR

FIELD OF INVENTION

The present invention relates generally to an elevator, and more specifically to a machine roomless elevator.

BACKGROUND OF THE INVENTION

Currently, a machine roomless elevator has been increasingly used in various occasions since it occupies smaller spaces than conventional elevators having a machine room. The machine roomless elevator usually includes a long strip-shaped traction machine which has a traction sheave with a smaller diameter. The long strip-shaped traction machine refers to a machine having a smaller radial size and a larger axial size which usually occupies smaller hoistway spaces. Thus, such traction machine can have a smaller overall size, and can be easily installed on a hoistway. Further, such traction machine and a fixing base thereof have a good stress status.

However, in order to satisfy a standard requirement that a diameter of the traction sheave should be 40 times or more than those of hoist ropes, the smaller diameter of the traction sheave necessarily requires smaller diameters of the hoist ropes. In this situation, more hoist ropes may be required to bear same workloads. The increase in the number of the hoist ropes can result in two troubles for a layout of the machine roomless elevator. Firstly, it will result in the increases of widths of the counterweight suspension wheel and the counterweight housing, thereby increasing a size of the hoistway. Secondly, interferences among the hoist ropes will be easily caused if too many hoist ropes round one counterweight suspension wheel.

The Chinese utility model patent 03267908.4 discloses a machine roomless elevator, whose driving device is connected to at least two coaxial traction sheaves, each traction sheave hoisting a car and a counterweight by means of a group of hoist ropes. However, since there are two independent and separate groups of the hoist ropes and the traction sheaves, the size of the hoistway is inevitably increased. Further, due to limitations on the development of the traction machine, it is difficult to implement the traction machine having two traction sheaves.

In addition, the above-mentioned patent also discloses that a rotary plane of the counterweight suspension wheel is perpendicular to a car wall at the counterweight side. However, since an axial size of the counterweight suspension wheel usually is smaller than a radial size thereof, the size of the hoistway would be increased if the rotary plane of the counterweight suspension wheel is perpendicular to the car wall at the counterweight side, which can result in the increase in costs of civil works. Further, such arrangement of the counterweight suspension wheel also may result in interferences between the hoist ropes in the car side and the counterweight side.

SUMMARY OF THE INVENTION

The present invention is directed to a machine roomless elevator, which is reasonable in structure designs and economic in civil works, and can avoid cross interferences between the hoist ropes.

According to one aspect of the present invention, there are provided a machine roomless elevator comprising a car within a hoistway; a counterweight within a space between said car and a wall of said hoistway, and on which a plurality of counterweight suspension wheels are arranged; and a traction sheave. Hoist ropes can be divided into a plurality of groups corresponding to the number of said counterweight suspension wheels after one ends thereof round said traction sheave, each group being fixed on a counterweight side termination after rounding corresponding one of said counterweight suspension wheels.

Preferably, one or more car suspension wheel can be provided on the car. Another ends of the hoist ropes can be fixed on a car side termination after rounding the car suspension wheels.

Preferably, in the projection on a hoistway transverse plane, the intersection angle between an axis of the traction sheave and a radial line of each counterweight suspension wheel can be between 0-45 degrees.

Preferably, the machine roomless elevator can comprise a traction machine disposed above a path of the counterweight, for driving the traction sheave. More preferably, said traction machine can be a long strip-shaped traction machine.

Preferably, in the projection on a hoistway transverse plane, the axis of the traction sheave and the radial line of each counterweight suspension wheel can be substantially in parallel each other.

Preferably, a rotary plane of the traction sheave is substantially perpendicular to a car wall at a counterweight side.

Preferably, the machine roomless elevator can comprise a plurality of traction sheave.

Preferably, the counterweight suspension wheels can comprise two or more counterweight suspension wheels.

Compared with the prior art, the present invention has the following technical effects:

Firstly, in the machine roomless elevator according to the present invention, two or more counterweight suspension wheel are provided on the counterweight, and hoist ropes can be divided into a plurality of groups corresponding to the number of the counterweight suspension wheels after one ends thereof round the traction sheave, each group being fixed on a counterweight side termination after rounding corresponding one of said counterweight suspension wheels. Thus, the solution according to the present invention can solve the problem caused by too many hoist ropes, such as the increase of the widths of the counterweight suspension wheels, and the increase of the hoistway size, etc. Further, the solution according to the present invention also can avoid interferences caused by too many hoist ropes rounding one counterweight suspension wheel.

In addition, according to the present invention, a rotary plane of the traction sheave can be perpendicular to a car wall at a counterweight side, and in the projection on a hoistway transverse plane, an axis of the traction sheave and a radial line of each counterweight suspension wheel can be in parallel each other. In this situation, a rotary plane of the counterweight suspension wheel can be parallel to the car wall at a counterweight side. Thus, a distance between the hoistway wall and the car wall at a counterweight side can be further reduced. Further, interferences between the hoist ropes in the car side and the counterweight side can also be effectively avoided.

The features and advantages of the present invention will be described in the following detailed description of the embodiments of the present invention. For those persons skilled in the art, other features and advantages of the present invention will become apparent from the following detailed description.

DETAILED DESCRIPTION OF PREFERRED EMBODIMENTS

Embodiments of the present invention will be described in detailed with reference to the accompanying drawings. It should be noted that the embodiments described herein are only for the purpose of the description, and not limitations for various aspects of the present invention. In the accompanying drawings, the like reference numbers represent the same or corresponding components.

The First Embodiment

Figure 1:
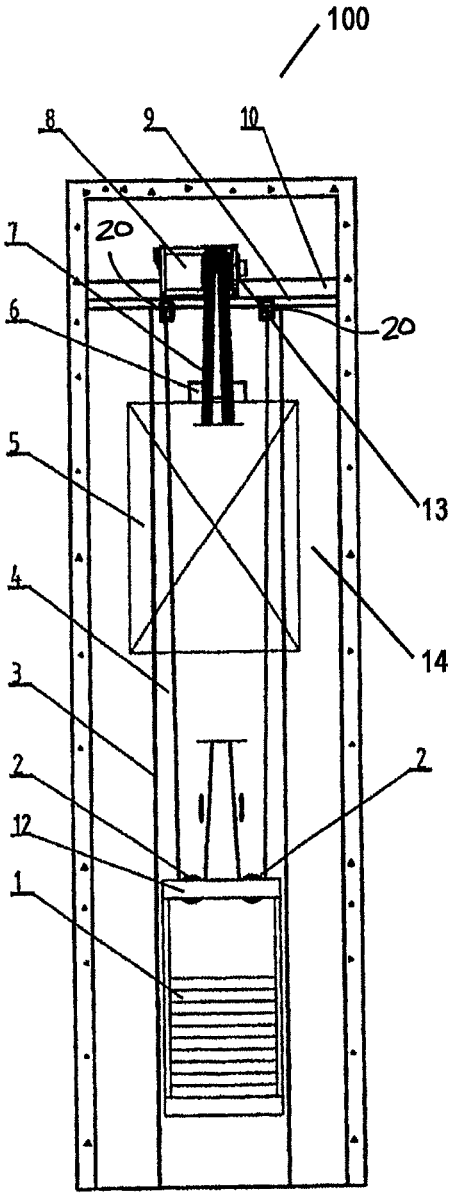
FIG. 1 is a plane view of a hoisway showing a machine roomless elevator according to the first embodiment of the present invention.
Figure 2:
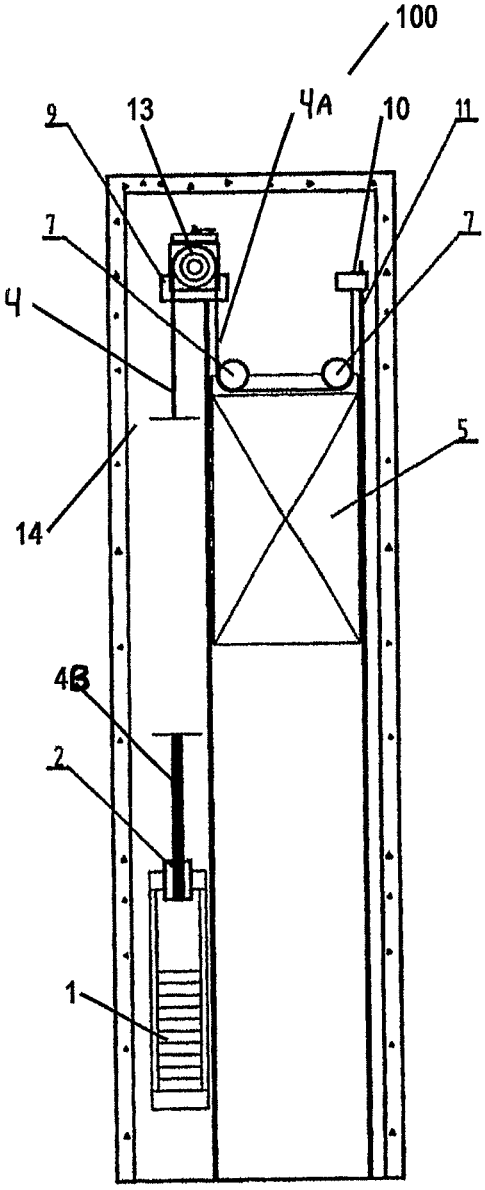
FIG. 2 is a left view of the hoistway of FIG. 1.

With reference to now to the figures, FIG. 1 is a plane view of a hoisway showing a machine roomless elevator according to the first embodiment of the present invention; and FIG. 2 is a left view of the hoisway of FIG. 1.

As illustrated in FIGS. 1 and 2, a machine roomless elevator 100 according to the first embodiment of the present invention comprises a counterweight 1, two counterweight suspension wheels 2, a counterweight guide rail 3, hoist ropes 4, a car 5, a car suspension wheel support member 6, two car suspension wheels 7, a traction machine 8, and a support beam 9 for supporting the traction machine 8.

The car 5 is located within an elevator hoistway 14, and has a common box-shaped structure. Typically, the car 5 can move up and down along a car guide rail 11. As shown in FIG. 2, the two car suspension wheels 7 are rotatablely disposed above the car 5 by means of the car suspension wheel support member 6. It will be understand by those skilled in the art that the car suspension wheels 7 also can be disposed below the car 5.

The counterweight 1 is disposed within a counterweight housing 12 which can be provide within a space between a wall of the elevator hoistway 14 and the car 5. Further, as shown in FIG. 1, the two counterweight suspension wheels 2 can be installed on the counterweight housing 12. Optionally, the two counterweight suspension wheels 2 also can be directly installed on the counterweight 1. Typically, the counterweight 1 can move up and down along the counterweight guide rail 3.

The support beam 9 can be a steel beam, and two ends thereof are supported on the opposite hoistway walls and are located above the hoistway. The support beam 9 can also be installed on two counterweight rails 3 and one car rail 11.

The traction machine 8 can be installed on the support beam 9 by means of a traction machine base (not shown in the Figures), and located above a path of the counterweight 1. As shown in FIGS. 1 and 2, the traction machine 8 is a long strip-shaped traction machine, and has a cylindrical shape. It should be understand by those skilled in the art that the traction machine 8 can also have other shapes, such as the traction machine being concave in the middle and cylindrical in the two ends, or the traction machine being concave in the middle and cubical in the two ends, etc.

A traction sheave 13 can be coupled to the traction machine 8. The traction machine 8 is used as a driving means for driving the traction sheave 13.

According to the first embodiment of the present invention, in the projection on a hoistway transverse plane, the intersection angle between an axis 13' of the traction sheave 13 and a radial line 2' of each counterweight suspension wheel 2 can be between 0-45 degrees.

Figure 3:
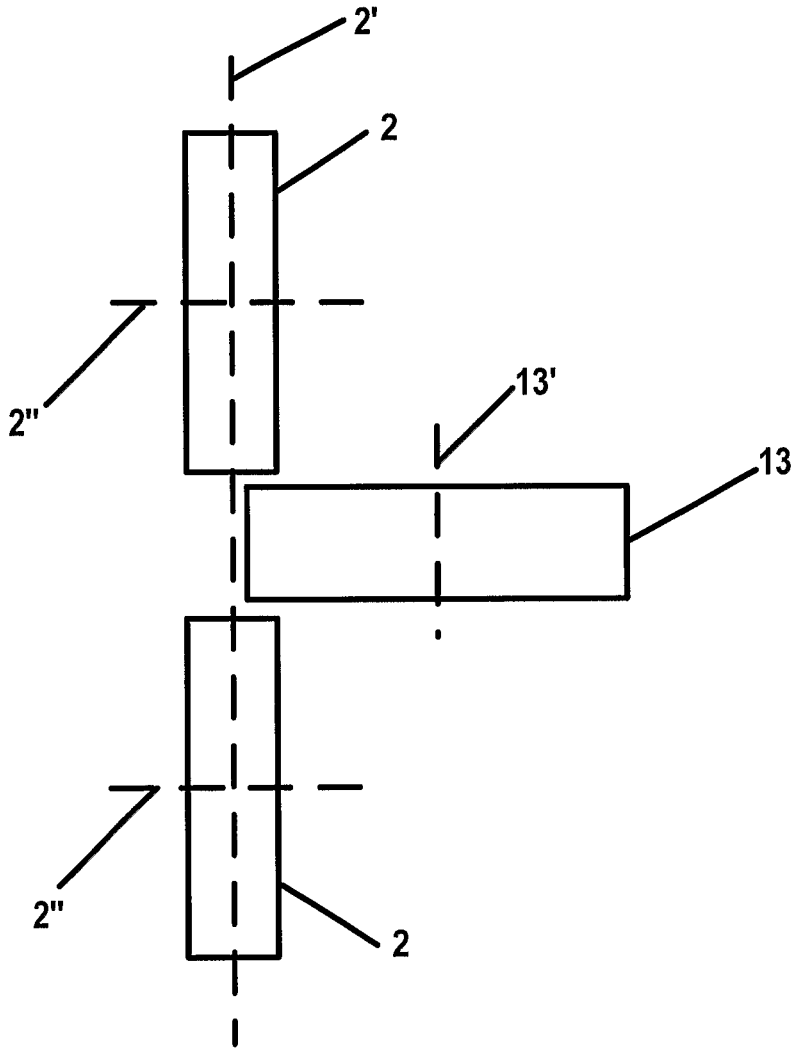
FIGS. 3 to 6 respectively illustrate various relative positions (angles) of an axis of the traction sheave and a radial line of an individual counterweight sheave projected on a hoistway transverse plane.
Figure 4:
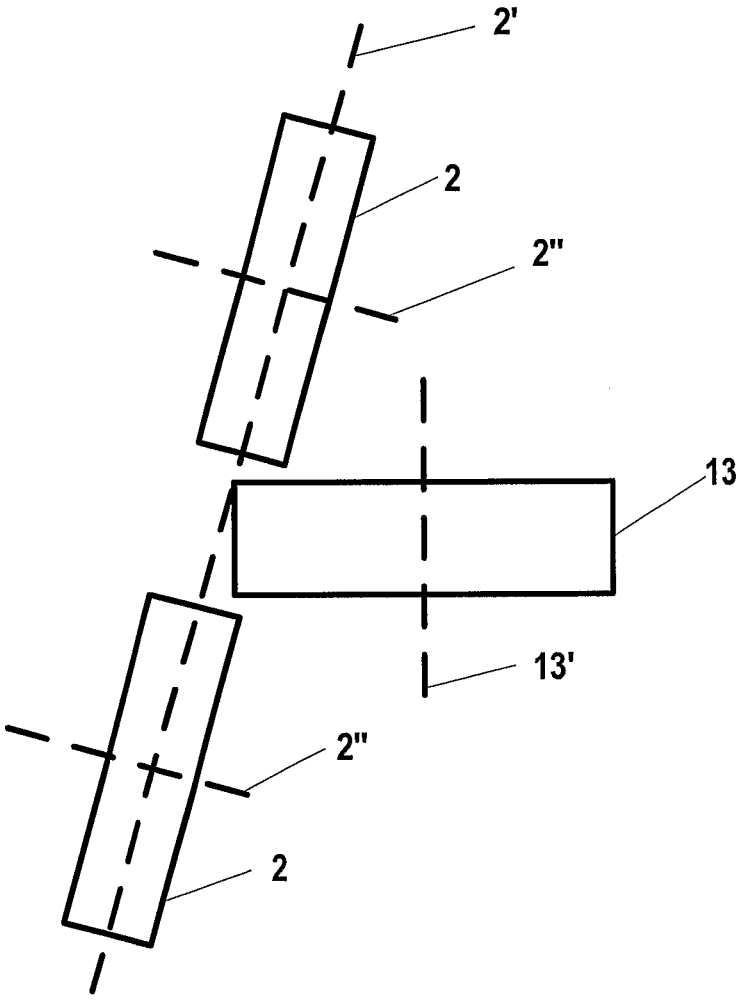
Figure 5:
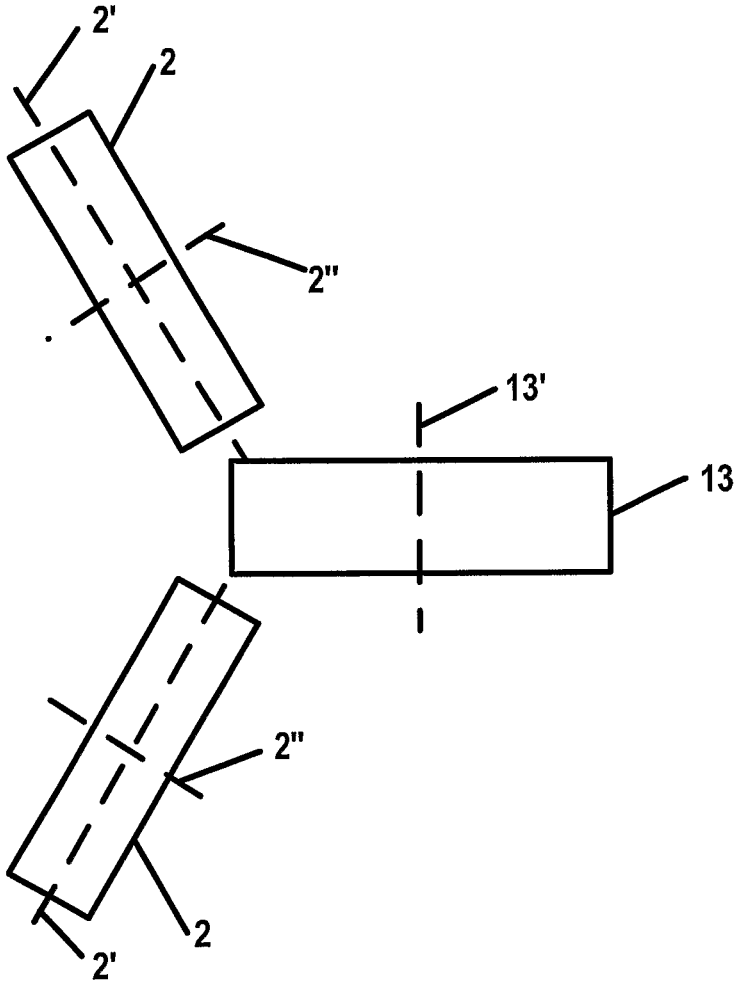
Figure 6:
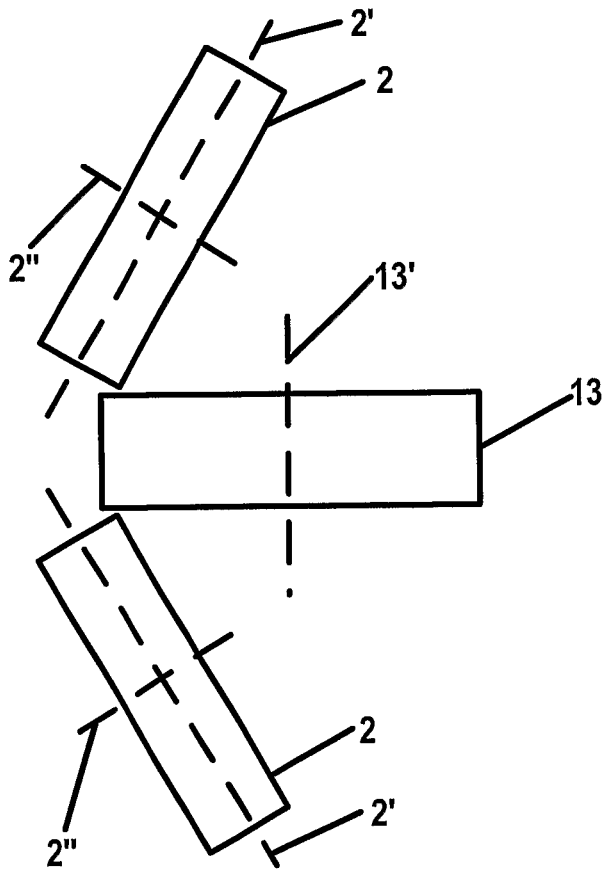

As shown in FIG. 3, in the projection on a hoistway transverse plane, the axis 13' of the traction sheave 13 and the radial line 2' of each counterweight suspension wheel 2 are in parallel each other. Namely, the axis 13' of the traction sheave 13 is substantially perpendicular to the axis 2" of each counterweight suspension wheel 2. Thus, when the rotary plane of the traction sheave 13 is substantially perpendicular to a car wall at the counterweight side, a rotary plane of the counterweight suspension wheels 2 is parallel to the car wall at the counterweight side. Optically, the axis 13' of the traction sheave 13 and the radial line 2' of each counterweight suspension wheel 2 projected on a hoistway transverse plane can also have relative positional relationship as shown in FIGS. 4-6.

According to the first embodiment of the present invention, one ends 4A (e.g., ends of the portions of the hoist ropes 4 between the car 5 and the counterweight 1, with the ends 4A being at the car side) of the hoist ropes 4 round the two car suspension wheels 7 and then are fixed on a car side rope termination 10. Further, the hoist ropes 4 can be divided into two groups after the other ends 4B thereof round the traction sheave, each group being fixed on a counterweight side rope termination 20 after rounding a corresponding one of the counterweight wheels 2. According to this embodiment, the counterweight side rope termination 20 can be integrated with the support beam 9 or fixed to the support beam 9.

The Second Embodiment

Figure 7:
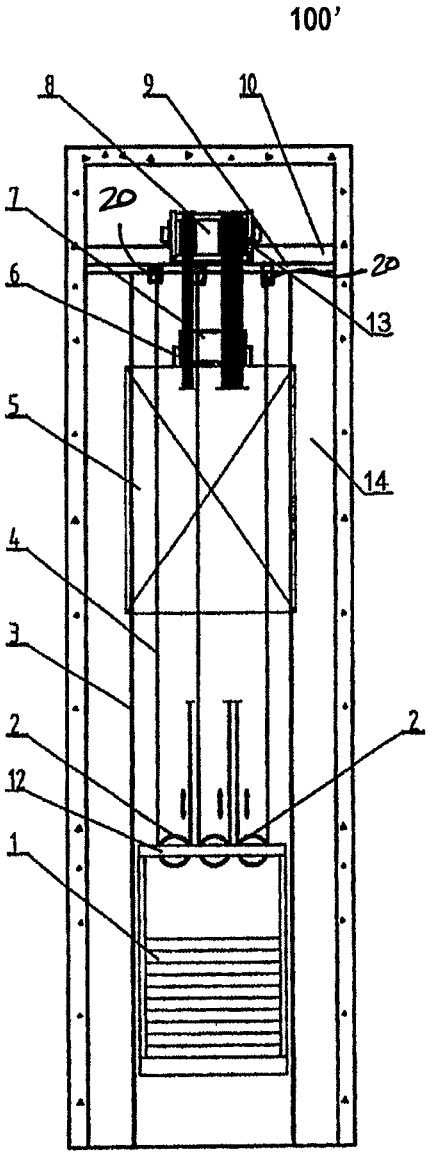
FIG. 7 is a plane view of a hoistway showing a machine roomless elevator according to the second embodiment of the present invention.
Figure 8:
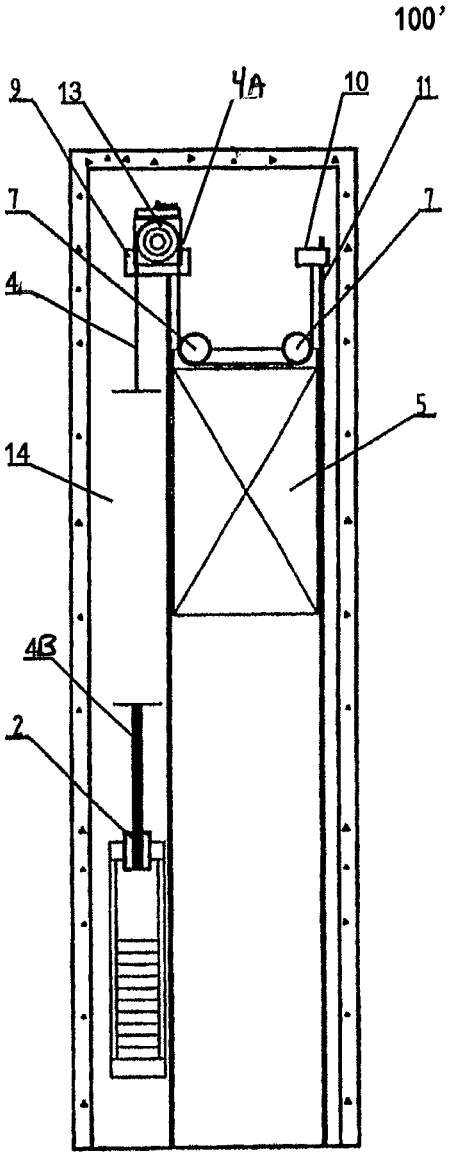
FIG. 8 is a left view of the hoisway of FIG. 7.

FIG. 7 is a plane view of a hoisway showing a machine roomless elevator according to the second embodiment of the present invention; and FIG. 8 is a left view of the hoisway of FIG. 7.

As illustrated in FIGS. 7 and 8. the machine roomless elevator 100' of the second embodiment differs from that of the first embodiment in that the traction machine 8 has two traction sheaves 13, and three counterweight suspension wheels 2 are arranged on the counterweight 1. The other structures are all the same.

According to the second embodiment of the present invention, one ends 4A (e.g.. ends of the portions of the hoist ropes 4 between the car 5 and the counterweight 1, with the ends 4A being at the car side) of the hoist ropes 4 round the two car suspension wheels 7 and then are fixed on the car side rope termination 10. Further, the hoist ropes 4 can be divided into three groups after another ends 4B thereof round the traction sheave, each group being fixed on the counterweight side rope termination 20 after rounding the corresponding counterweight wheel 2.

OTHER EMBODIMENTS

According to the present invention, the number of the counterweight suspension wheels 2 can also be four or more. In this case, the hoist ropes 4 can be divided into a plurality of groups corresponding to the number of the counterweight suspension wheels 2 after one ends thereof round the traction sheave 13. Then, each group can be fixed on the counterweight side termination after rounding the corresponding one of the counterweight suspension wheels 2.

According to the present invention, the positional relationship between the counterweight suspension wheels 2 and the traction sheave 13 is not limited to the structure shown in FIGS. 3-6, and the other angle also be applied to the present invention.

While the preferable embodiments of the present invention have been particularly shown and described therein, it will be understood by those skilled in the art that the present invention is not limited only to those embodiments, and various modifications and changes can be made without departing from the spirit and scope of the appended claims.

What is claimed is:

1. A machine-roomless elevator comprising:

a car within a hoistway;

a counterweight within a space between said car and a wall of said hoistway, and on which a plurality of counterweight suspension wheels is arranged;

a traction sheave; and a plurality of hoist ropes that is arranged to round the traction sheave, wherein the hoist ropes are divided into a plurality of groups corresponding to a number of said counterweight suspension wheels after corresponding portions of the hoist ropes round said traction sheave, each group rounding a corresponding one of the counterweight suspension wheels with a first one of the groups rounding a first one of the counterweight suspension wheels without rounding a second one of the counterweight suspension wheels and a second one of the groups rounding the second one of the counterweight suspension wheels without rounding the first one of the counterweight suspension wheels each group being fixed on a counterweight-side termination after rounding the corresponding one of said counterweight suspension wheels.

2. The machine-roomless elevator according to claim 1, wherein in a projection on a hoistway transverse plane, an intersection angle between an axis of the traction sheave and a radial line of each counterweight suspension wheel is between 0-45 degrees.

3. The machine-roomless elevator according to claim 2, wherein in a projection on a hoistway transverse plane, the axis of the traction sheave and the radial line of each counterweight suspension wheel are substantially parallel to each other.

4. The machine-roomless elevator according to claim 1, further comprising a traction machine disposed above a path of said counterweight, for driving said traction sheave.

5. The machine-roomless elevator according to claim 4, wherein said traction machine is a long strip-shaped traction machine.

6. The machine-roomless elevator according to claim 1, further comprising one or more car suspension wheels arranged on said car, wherein ends of said hoist ropes are fixed on a car-side termination after rounding said car suspension wheels.

7. The machine-roomless elevator according to claim 1, wherein a rotary plane of the traction sheave is substantially perpendicular to a car wall at a counterweight-side.

8. The machine-roomless elevator according to claim 1, wherein said elevator comprises one or more traction sheaves.

9. The machine-roomless elevator according to claim 1, wherein said counterweight suspension wheels comprise two or more counterweight suspension wheels.

10. A machine-roomless elevator system, comprising:

an elevator car;

a counterweight including a plurality of counterweight suspension wheels;

a traction sheave; and a plurality of hoist members arranged with a first number of the hoist members wrapping at least partially around the traction sheave, a second number of the plurality of hoist members wrapping at least partially around a first one of the counterweight suspension wheels, a third number of the plurality of hoist members at least partially wrapping around a second one of the counterweight suspension wheels, wherein the second number is less than the first number and the third number is less than the first number.

11. The elevator system of claim 10, wherein the second number equals the third number.

12. The elevator system of claim 11, wherein a sum of the second number and the third number equals the first number.

13. The elevator system of claim 10, wherein the hoist members that wrap around the first one of the counterweight suspension wheels do not wrap around the second one of the counterweight suspension wheels.

14. An elevator system, comprising:

an elevator car;

a counterweight;

a plurality of counterweight suspension wheels supported for movement with the counterweight;

a traction sheave; and a plurality of hoist members arranged to at least partially wrap around the traction sheave, a first group of the plurality of hoist members following a first path that includes at least partially wrapping around the first one of the counterweight suspension wheels and a second group of the plurality of hoist members following a second, different path that includes wrapping at least partially around a second one of the counterweight suspension wheels;

wherein an entirety of the plurality of hoist members wraps at least partially around the traction sheave;

less than the entirety of the plurality of hoist members wraps at least partially around the first one of the counterweight suspension wheels; and less than the entirety of the plurality of hoist members wraps at least partially around the second one of the counterweight suspension wheels.

* * * * *